United States Patent [19]

Dilmore et al.

[11] 4,339,323

[45] Jul. 13, 1982

[54] BIPOLAR ELECTROLYZER ELEMENT

[75] Inventors: Colonel R. Dilmore, Portland; Carl W. Raetzsch, Jr., Corpus Christi, both of Tex.; Thomas C. Jeffery, Lake Charles, La.; Dallas D. Dupre, III, Pittsburgh, Pa.

[73] Assignee: PPG Industries, Inc., Pittsburgh, Pa.

[21] Appl. No.: 188,401

[22] Filed: Sep. 18, 1980

[51] Int. Cl.[3] ..... C25B 9/04; C25B 11/10; C25B 13/08

[52] U.S. Cl. ..... 204/256; 204/268; 204/282; 204/288; 204/290 F

[58] Field of Search ..... 204/254–255, 204/256, 268, 270, 279, 288, 282–283, 290 F

[56] References Cited

U.S. PATENT DOCUMENTS

| | | | |
|---|---|---|---|
| 3,759,813 | 9/1973 | Raetzsch et al. | 204/256 |
| 3,813,326 | 5/1974 | Gunby | 204/256 X |
| 3,849,280 | 11/1974 | Raetzsch et al. | 204/256 |
| 3,859,197 | 1/1975 | Bouy et al. | 204/284 |
| 3,884,792 | 5/1975 | McGilvery | 204/290 G X |
| 3,919,059 | 11/1975 | Raetzsch et al. | 204/129 |
| 4,017,375 | 4/1977 | Pohto | 204/255 |
| 4,093,525 | 6/1978 | Cunningham | 204/98 |
| 4,111,779 | 9/1978 | Seko et al. | 204/255 |
| 4,116,805 | 9/1978 | Ichisaka et al. | 204/290 F |
| 4,132,622 | 1/1979 | Kenney | 204/268 |
| 4,137,144 | 1/1979 | Kenney | 204/268 |
| 4,137,145 | 1/1979 | Wallace | 204/290 R |
| 4,138,324 | 2/1979 | Meyer | 204/268 X |
| 4,141,815 | 2/1979 | Ichisaka et al. | 204/290 F |
| 4,269,688 | 5/1981 | Du Bois | 204/256 X |
| 4,279,731 | 7/1981 | Pellegri | 204/290 F X |

*Primary Examiner*—Delbert E. Gantz
*Assistant Examiner*—Donald R. Valentine
*Attorney, Agent, or Firm*—Richard M. Goldman

[57] ABSTRACT

Disclosed is a bipolar electrolyzer having a plurality of individual electrolytic cells electrically and mechanically in series with a bipolar element between pairs of adjacent individual cells. The bipolar element has an anodic side with anodes of the first electrolytic cell of a pair of electrolytic cells depending therefrom, and a cathodic side with the cathodes of the second electrolytic cell of the pair of electrolytic cells depending therefrom. The anodic side of the bipolar element has an acidified alkali metal chloride resistant valve metal surface, and the cathodic side of the bipolar element has an alkali metal hydroxide resistant transition metal surface. The bipolar electrolyzer is characterized by the bipolar element having a bonded laminate of a valve metal and a transition metal, a first metal plate of a transition metal, intermittently bonded to the transition metal member of the bonded laminate at the first joints, and a second transition metal plate above the first joints, that is, above the joints between the first transition metal plate and the bonded laminate. The second metal plate is bonded to the first metal plate and second joints whereby to protect the first joints from contact with the catholyte liquor.

8 Claims, 5 Drawing Figures

BIPOLAR ELECTROLYZER ELEMENT

DESCRIPTION OF THE INVENTION

A bipolar electrolyzer contains a plurality of individual electrolytic cells, electrically and mechanically in series. The series structure is provided through a sequential replication of common structural units, i.e., bipolar units, also known as bipolar elements. The sequence of these common structural units, i.e., the number of cells in the electrolyzer, is generally 3 or more, for example 10 or even 20 or more, depending upon the availability of electrical power and the transformer capacity.

The common structural element, that is, the bipolar unit or bipolar element, includes a backplate. The cathodes of one cell depend from the cathodic surface thereof, and anodes of the next adjacent cell in the electrolyzer depend from the anodic surface of the backplate. The structural, chemical, and electrical requirements placed upon the backplate of the bipolar element require the backplate to be chemically resistant. That is, the backplate must have one anolyte resistant surface, i.e., a surface of a material resistant to acidified, chlorinated, saturated, brine at a pH of from about 2.5 to about 5.5, at temperature approaching the boiling point thereof. The opposite surface of the backplate must be a catholyte resistant surface. That is, it must be a surface of a material resistant to concentrated aqueous caustic soda or caustic potash, e.g., aqueous solutions containing from about 10 to about 50 weight percent of sodium hydroxide, or from about 10 to about 65 weight percent of potassium hydroxide, and in diaphragm cells, up to 15 weight percent sodium chloride, or up to 25 weight percent potassium chloride.

The backplate must also have means for preventing hydride formation at the interface of the anolyte resistant element of the backplate, and the catholyte resistant element of the backplate. This is to prevent the hydrogen that is formed at the interface of the catholyte resistant surface with the catholyte liquor from forming hydride at the interface between the anolyte and catholyte resistant elements of the backplate.

Moreover, the backplate must be structurally rigid, that is, it must be able to carry the anodes on one side, and the cathodes on the opposite sides, especially where the electrodes extend perpendicularly outwardly therefrom, and are interleaved between electrodes of opposite polarity.

The backplate must further have low resistance to the flow of electrical current from the cathodes of one electrolytic cell, mounted on the cathodic surface thereof, to the anodes of the next adjacent electrolytic cell, mounted on the anodic surface thereof.

It has now been found that these ends may be accomplished by a bipolar element where the backplate has a bonded laminate of a valve metal and a transition metal, the valve metal facing the anodes and in contact with the anolyte liquor, and the transition metal on the opposite side of the laminate, and shielded from the anolyte liquor by the valve metal element of the laminate. The backplate herein contemplated has a first transition metal plate, bonded to the transition metal member of the laminate, and interposed between the laminate and the cathodes and catholyte liquor. The first plate is bonded to the laminate in a manner to allow hydrogen to collect between the first plate and the laminate and be vented therefrom. Such bonding may be provided by intermittent bonds, such as plug welds. The bipolar element herein contemplated further has a second transition metal plate, bonded to the first transition metal plate, and located above the bonds between the first plate and the laminate. The second plate protects the bonds from contact with catholyte liquor.

Optionally, the bipolar element herein contemplated may contain first hydrogen vent conduits. The first hydrogen vent conduits are exemplified by conduits through the first transition metal plate, between the transition metal surface of the laminate and the second plate. The first hydrogen vent conduits are in combination with the second hydrogen vent conduits. The second hydrogen vent conduits carry the hydrogen to the outside of the cell, and may be a groove or channel along the transition metal surface of the laminate, or along the back surface of the first plate, i.e., the surface of the first plate in contact with the laminate, or pairs of grooves or channels between the laminate and the first plate.

As herein contemplated, the bipolar element having the structure herein described may be used in a cell having interleaved, fingered electrodes. Alternatively, the bipolar element may be used in a bipolar electrolyzer wherein the individual electrolytic cells have planar electrodes, parallel to each other and to the backplate, and spaced from each other and spaced from the backplate, i.e., as in a filter press cell. Alternatively, the bipolar element herein described may be utilized in an electrolytic cell having planar electrodes, parallel to each other, parallel to and spaced from the backplate, and with one or both of the electrodes having active electrocatalytic surfaces thereof removably and compressively bearing upon the permionic membrane but not bonded thereto, for example as described in the commonly assigned copending U.S. application Ser. No. 76,898 filed Sept. 19, 1979 of Donald W. DuBois and William B. Darlington for Solid Polymer Electrolyte Chlor Alkali Process and Electrolytic Cell.

THE FIGURES

DETAILED DESCRIPTION OF THE INVENTION

The bipolar element herein contemplated is illustrated with respect to a bipolar electrolyzer of the type shown in U.S. Pat. Nos. 3,759,813; 3,819,280; 3,928,165; 3,910,827; 3,876,517; 3,855,091; 3,928,150; 3,968,021; 4,174,266; having fingered, interleaved electrodes extending substantially perpendicularly outwardly from the backplate.

However, it is to be understood that the backplate described herein may also be utilized in electrolytic cells having electrodes parallel to the backplate, that is, as in pancake cells, and in cells wherein the active electrocatalyst of the anode or the cathode or both is removably and compressively bearing upon the permionic membrane.

Figure 1:
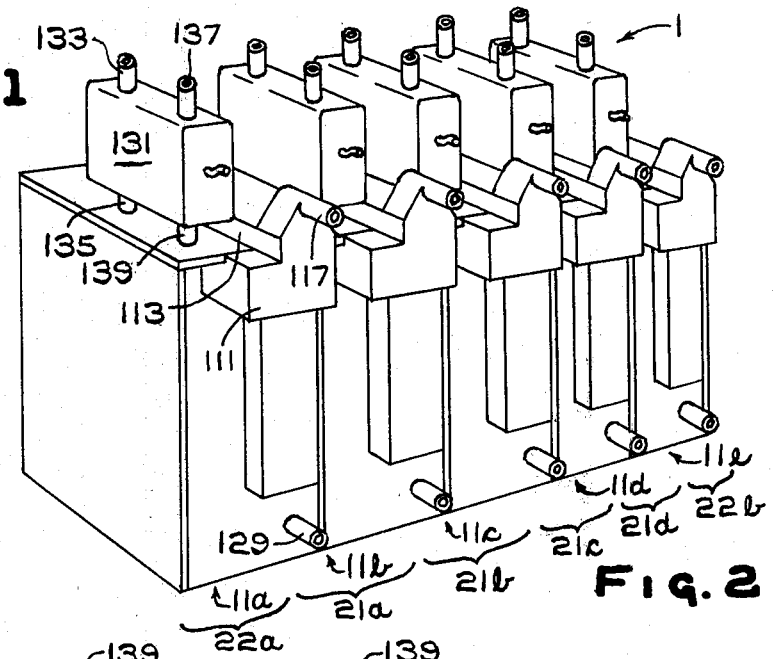
FIG. 1 is an isometric view of a bipolar electrolyzer having the bipolar element herein contemplated.

Bipolar electrolyzer 1 is shown generally in FIG. 1. As there shown, the bipolar electrolyzer is made up of individual electrolytic cells 11*a*, 11*b*, 11*c*, 11*d*, and 11*e*. The individual electrolytic cells 11*a*, 11*b*, 11*c*, 11*d*, and 11*e*, are made up of bipolar elements 21*a*, 21*b*, 21*c*, 21*d*, and end half cell units 22*a*, and 22*b*. Cell 11*a* is made up of end unit 22*a* and bipolar unit 21*a*, while cell 11*e* is made up of end unit 22*b* and bipolar unit 21*d*. The intermediate cells, 11*b*, *c*, and *d*, are made up of two bipolar units, as 21*a* and 21*b*, 21*b* and 21*c*, and 21*c* and 21*d*.

The bipolar electrolyzer shown in FIG. 1 has hydrogen caustic soda separating means, i.e., means for separating the hydrogen gas evolved at the cathodes from the liquid electrolyte. The hydrogen-caustic soda separating means include horizontal gas channel 113, and separater tank 111 with hydrogen line 117 to a hydrogen header not shown. The hydrogen disengaging structure and method of using the same are described in U.S. Pat. Nos. 3,968,021 and 3,928,150 the disclosures of which are incorporated herein by reference.

The catholyte liquor, that is, the caustic soda solution, the caustic potash solution, the caustic soda-salt solution, or the caustic potash-potassium chloride solution, is recovered from the catholyte compartment of the electrolytic cell through caustic outlet 129 which leads to a caustic header not shown.

The brine feed and chlorine recovery is accomplished in brine tank 131 which has brine inlet 133 to the tank 131 from a brine header, not shown, and brine line 135 from the tank 131 to an individual electrolytic cell 11. The brine feed, and chlorine recovery system further includes chlorine outlet 139 from the cell 11 to the brine tank 131, and chlorine outlet 137 from the tank 131 to a chlorine header not shown. The brine feed, and chlorine recovery tank is as described generally in U.S. Pat. No. 3,928,165 to Piester for Electrolytic Cell Including Means For Separating Chlorine From the Chlorine-Electrolyte Froth Formed in the Cell, and functions as described in U.S. Pat. No. 3,855,091 to Piester for Method of Separating Chlorine From the Chlorine-Anolyte Liquor Froth of an Electrolytic Cell, the disclosures of both of which are incorporated herein by reference.

The brine tank 131, the brine inlet 135 to the cell, and brine outlet 139 from the cell 11 to the brine tank 131 provide a circulatory motion to the anolyte liquor, brine, and chlorine as described in U.S. Pat. No. 4,174,266 to Jeffery for Method of Operating An Electrolytic Cell Having An Asbestos Diaphragm, the disclosure of which is incorporated herein by reference. A brine equalizer system maintains a uniform head of anolyte in each cell of the electrolyzer.

Figure 2:
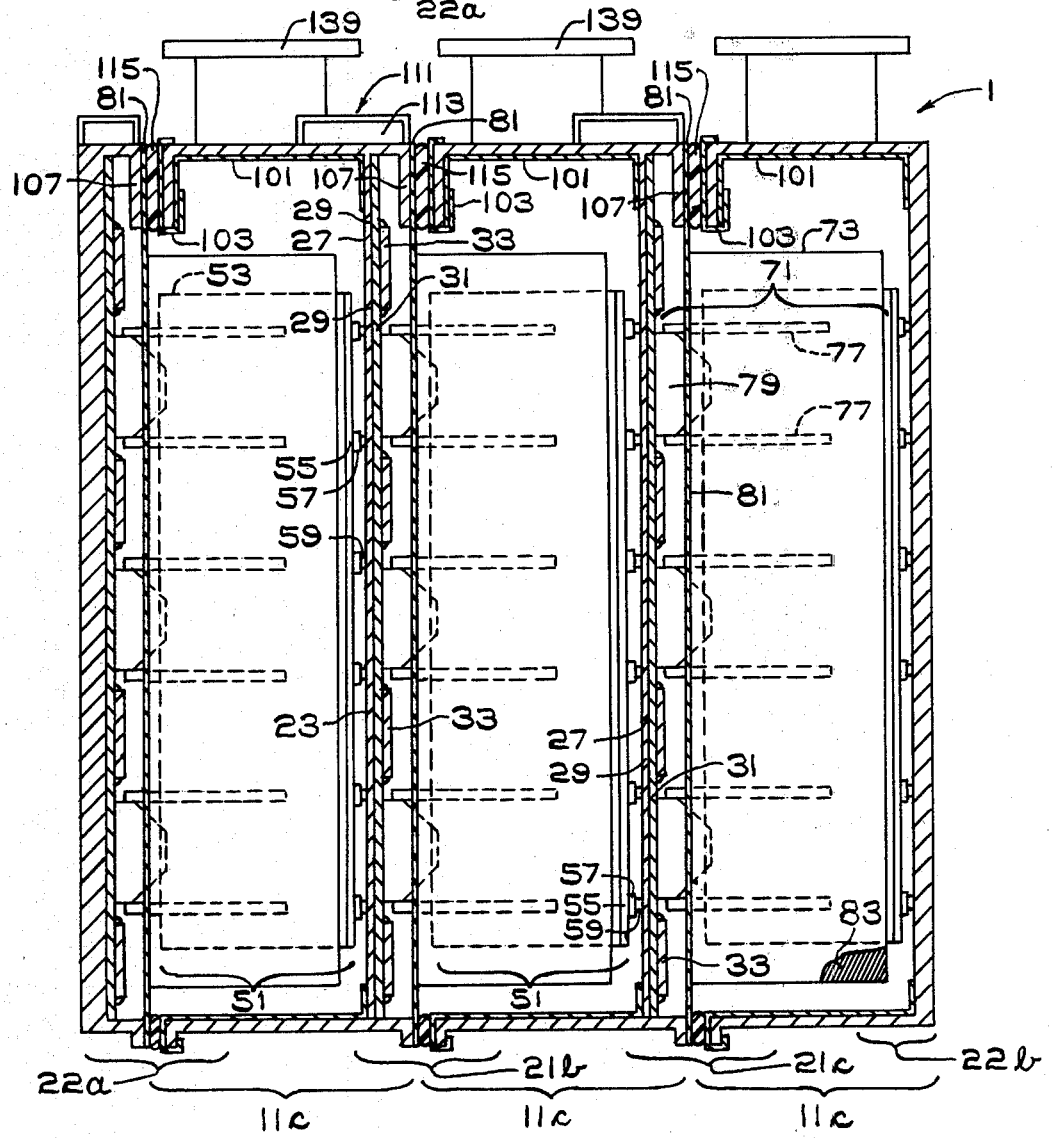
FIG. 2 is a cutaway side elevation of a bipolar electrolyzer having the bipolar element herein contemplated.
Figure 3:
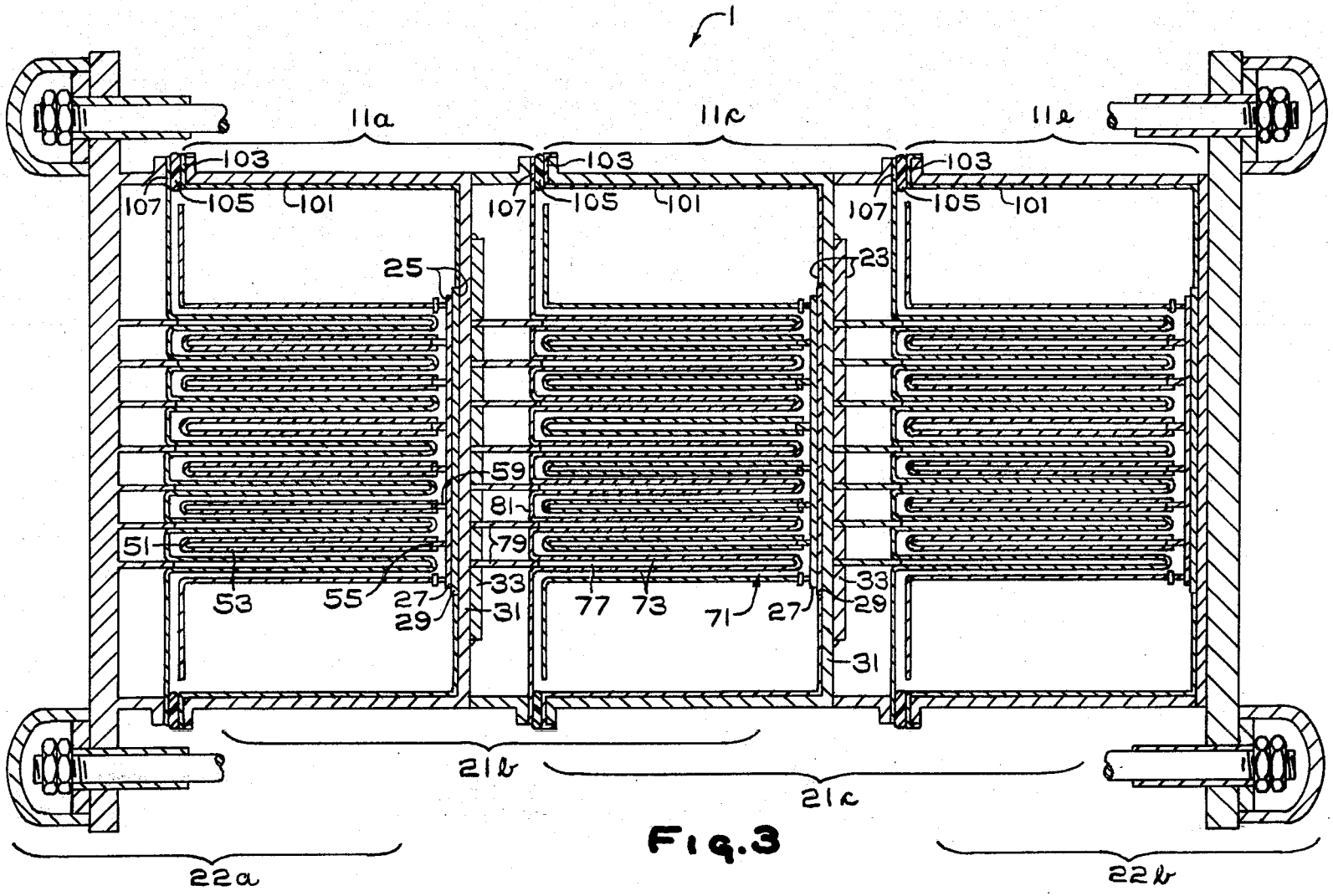
FIG. 3 is a cutaway plan view of a bipolar electrolyzer having the bipolar element herein contemplated.
Figure 4:
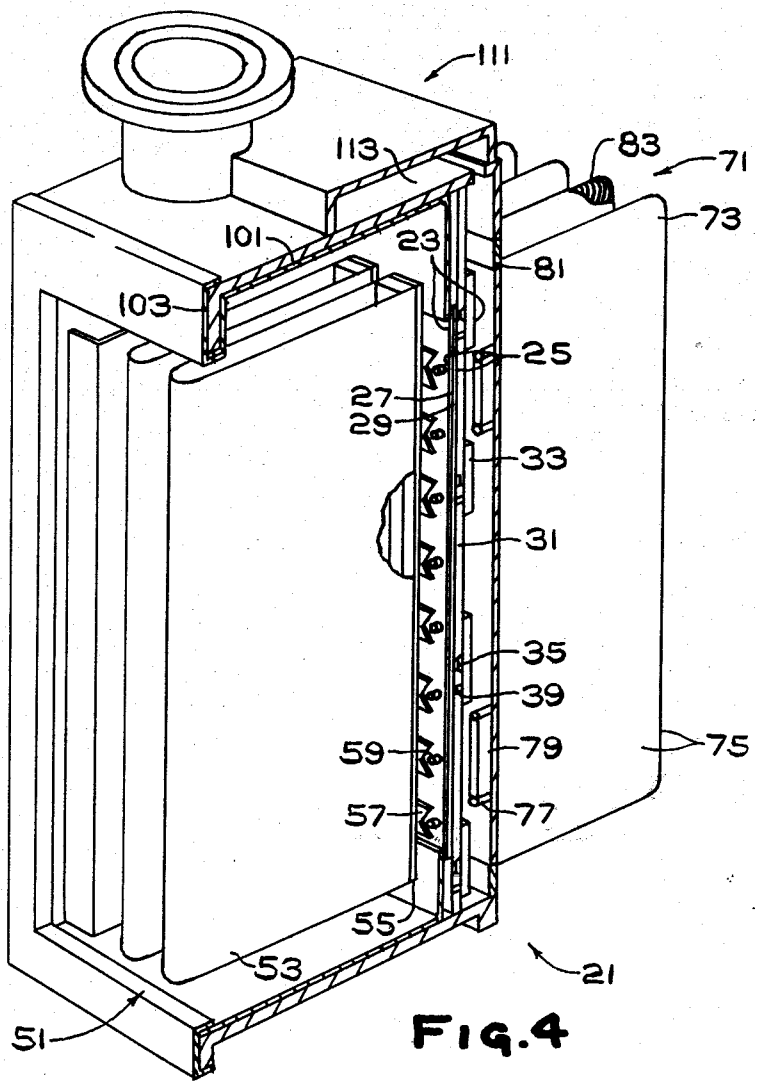
FIG. 4 is a cutaway isometric view of a bipolar unit having the backplate herein contemplated.

The bipolar electrolyzer having fingered, interleaved electrodes and incorporating the bipolar element of this invention is shown in cutaway in FIGS. 2, 3, and 4. FIG. 2 is a side elevation. FIG. 3 differs from FIG. 2 in being a plan view showing an alternative method of anode mounting. FIG. 4 is an isometric view of the single bipolar element shown in FIG. 2. As shown in FIGS. 2 and 3, the electrolyzer 1 includes individual cells 11*a*, 11*c*, and 11*e* made up of bipolar elements 21*a* and 21*c*, cathodic end unit 22*a* and anodic end unit 22*b*. Each individual bipolar element 21*a*, 21*c*, has a backplate 23 as will be described herein below, anodes 51 extending from one surface 27 of the backplate 23, and cathodes 71 extending from the opposite surface 31 of the backplate 23.

The bipolar element includes a backplate 23. The backplate 23 is made up of a laminate 25 with a valve metal sheet 27 and a transition metal plate 29.

As used herein, valve metals means those metals which form a corrosion resistant oxide upon exposure to acidic media, for example, titanium, tungsten, zirconium, niobium and hafnium. As used herein, transition metals include those metals which are normally used as materials of construction, and are resistant to the aqueous alkali metal hydroxide solutions, for example, iron, cobalt, nickel, molybdenum, and alloys thereof, for example, mild steel, and stainless steel.

The valve metal sheet 27 of the laminate 25 faces and is in contact with the anolyte liquor, and has the anodes 51 dependent therefrom. The transition metal plate 29 of the laminate 25 is separated from the anolyte liquor by the valve metal sheet 27 of the laminate 25.

In the bipolar element 21 herein contemplated, a first plate 31 is bonded to the transition metal plate 29 of the laminate 25, and a second plate 33 is bonded to the first plate 31. The second plate 33 is located over the bonds between the first plate 31 and the laminate 25.

For example, the first plate 31 can be discontinuously bonded to the laminate 25 as at plug welds 35. This allows electrical conduction between the first plate 31 and the laminate 25 primarily through the welds 25, but also allows hydrogen molecules $H_2$, to form from hydrogen atoms, $H^0{}_1$, therebetween and to be removed therefrom, i.e., to be bled therefrom.

The second plate 33 is bonded to the first plate 31, as at welds 37. The second plates 33 are located above the bonds 35 whereby to protect the bonds 35. Alternatively, the plurality of second plates 33 may be replaced by a single second plate 33. The single second plate 33 may be electron beam welded to the first plate.

The distance between weld 35, i.e., the weld between the laminate 25 and the first plate 31, and weld 37, i.e., the weld between the first plate 31 and the second plate 33, is great enough, relative to thickness of the first plate, 31, that atomic hydrogen generated on exposed surfaces of first plate 31, preferentially diffuses to channels, i.e., 39 and 141, and the external periphery of the cell, rather than to the weld 35. This is attained by making the boundaries of second plate 33, e.g., the location of weld 37, distant enough from weld 35, relative to the thickness of second plate 33, as to favor hydrogen diffusion toward the channels 39 and 141 over hydrogen diffusion toward weld 35. The distance from the boundary of second plate 33, i.e., from weld 37, to weld 35, should be at least two to ten times the thickness of second plate 33, and preferably three to eight times the thickness of the second plate 33.

The first plate 31 has hydrogen vents 39 therethrough whereby to collect monatomic hydrogen, $H^0{}_1$ formed at the interface between the plate 31 and the catholyte, and at the interface between the second plate 33 and the catholyte, and carried into and through the plates 31 and 33. The hydrogen vents 39 lead to volumes intentionally provided between the first plate 31 and the laminate 25. These volumes are bled outside the cell, as through bleed line 141 and bleed valve.

The laminate 23, that is, the laminate of the valve metal 25 and the transition metal 27 may be Detaclad TM or Dynaclad TM, that is, explosion clad or detonation clad materials. Typically, the valve metal sheet, that is, the titanium, tantalum, or tungsten sheet is from about 0.05 inch thick to about 0.1 inch thick, and the transition metal sheet, that is, the iron or steel sheet is generally from about 0.375 inch thick to about 1 inch thick. The first plate 31 is generally from about 0.25 inch thick to about 1 inch thick, and the second plate 33 is generally from about 0.25 inch thick to about 1 inch thick.

Figure 5:
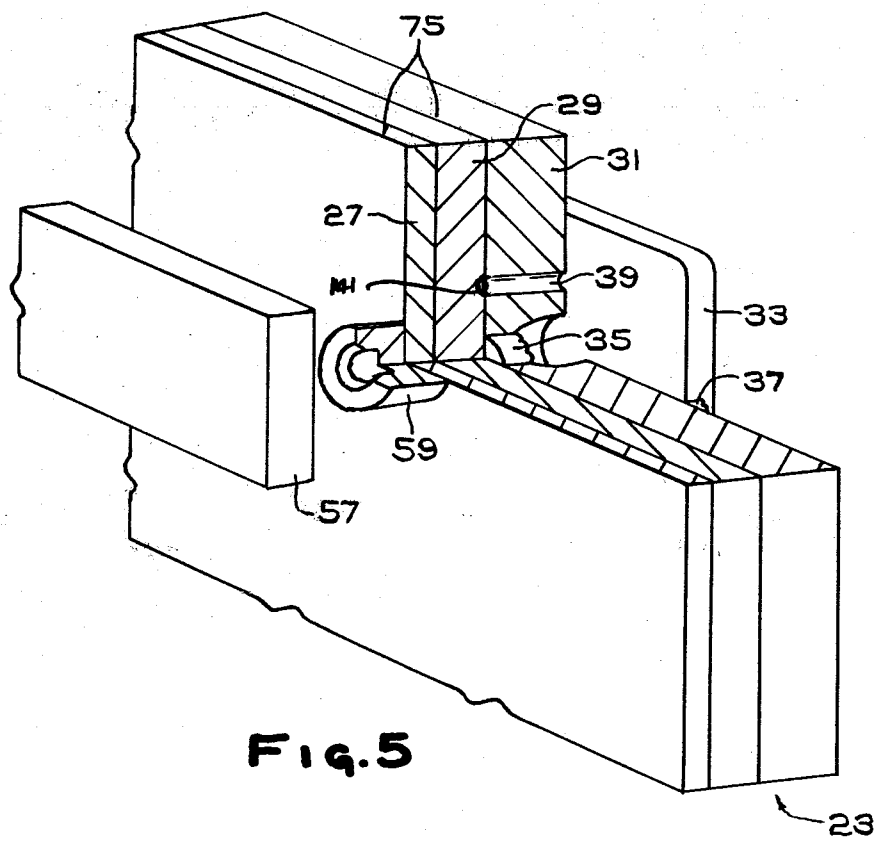
FIG. 5 is a cutaway isometric view of a backplate herein contemplated.

The anodes 51 include anode fingers 53 extending perpendicularly outwardly from the backplate 23. In one exemplification, the anodes 51 include an anode base 55 shown in FIGS. 2, 4, and 5. The anode base 55 is joined to an anode bar 57 which is joined to a stud 59, which is then joined to the valve metal surface 27 of the backplate 23.

In an alternative exemplification shown in FIG. 3, the anode base 55 is joined directly to the stud 59 or to a vertical array of studs 59 which are joined to the valve metal surface 27 to the backplate 23.

The opposite side of the backplate 23 has cathode elements 71. A cathode element 71 includes hollow cathode fingers 73 extending outwardly from the cathode surface 31 of the backplate 23. The cathode fingers 73 are formed in a closed envelope of perforated plate, perforated sheet, mesh, screen, or the like, with two substantially parallel surfaces 75 as the principal cathode area, and a permionic membrane or diaphragm 83 deposited on the cathode finger 73.

The surfaces 75 are carried by cathode support bar 77, which extend outwardly with a conducting plate 79 from the bipolar backplate 23. Other structures may be used, for example, the cathode support bar 77 may be dispensed with as where the membrane or separator 83 is not vacuum deposited, but is preformed or deposited by means other than drawing a vacuum within the cathode finger 73.

The cathode backscreen 81 with the permionic membrane laying thereon is substantially parallel to and spaced from the backplate 23. The volume within the hollow cathode fingers 73 and between the backscreen 81 and the backplate 23 is the catholyte volume.

The anode compartment includes a titanium liner 101 which may either lay upon or be spaced from the steel cell body. The anode compartment further includes a titanium flange 103 which bears upon the liner 101. A gasket 115 is interposed between the titanium flange 103 and transition metal flange 107 with the cathodic backscreen 81 extending between the transition metal flange 107 and the gasket 115 as described in U.S. Pat. No. 3,876,517 to Carl W. Raetzsch et al. for Reduction of Crevice Corrosion in Bipolar Chlorine Diaphragm Cells By Locating the Cathode Screen at the Crevice and Maintaining the Titanium Within the Crevice Anodic, the disclosure of which is incorporated herein by reference.

Also shown in the figure is chlorine outlet 139 to chlorine and brine tank 131, and hydrogen system 111, including the horizontal line thereof 113.

While the invention has been illustrated and described with respect to bipolar electrolyzers wherein the individual electrolytic cells are characterized by having interleaved, fingered electrodes. It is to be understood that the design of the backplate and the backplate concept herein described may be utilized in electrolytic cells where the electrode surfaces are substantially parallel to rather than perpendicular to the bipolar element 23. Such cells include cells where the anodes and cathodes are spaced from and parallel to each other and to the backplate 23, as well as those cells where either the anode or the cathode or both compressively and removably bear upon the permionic membrane so as to function as a solid polymer electrolyte.

While the invention has been described with reference to certain exemplifications and embodiments herein, the concept is not to be limited except as described in the claims amended hereto.

We claim:

1. In a bipolar electrolyzer having a plurality of individual electrolytic cells electrically and mechanically in series with a bipolar element between a pair of adjacent individual cells, the bipolar element having an anodic side with the anodes of the first electrolytic cell of said pair of electrolytic cells depending therefrom, and a cathodic side with the cathodes of the second electrolytic cell of said pair of electrolytic cells depending therefrom, said anodic side of the bipolar element comprising an acidified alkali metal chloride resistant valve metal surface, and said cathodic side of the bipolar element comprising an alkaline alkali metal hydroxide resistant transition metal surface, the improvement wherein said bipolar element comprises:

a clad laminate of a valve metal sheet and a transition metal plate joined at interior surfaces thereof;

a first transition metal plate intermittently bonded to the exterior surface of the transition metal plate of the clad laminate at first joints; and a second transition metal plate above the first joints and bonded to the first transition metal plate on the side thereof remote from the clad laminate at second joints whereby to protect the first joints from contact with catholyte liquor.

2. The bipolar electrolyzer of claim 1 wherein said bipolar element comprises first hydrogen vent conduits through the first transition metal plate, between the transition metal member of the clad laminate and the second transition metal plate.

3. The bipolar electrolyzer of claim 2 wherein said bipolar element comprises second hydrogen vent conduits between the cell exterior and the clad laminate, on the surface which contacts the clad laminate of the first transition metal plate.

4. The bipolar electrolyzer of claim 1 wherein said first transition metal plate is plug welded to the clad laminate.

5. The bipolar electrolyzer of claim 1 wherein the anodes extend perpendicularly from the anodic side of the bipolar element, and the cathodes extend perpendicularly from the cathodic side of the bipolar element, whereby the cathodes are interleaved between the anodes of the prior bipolar element and the anodes are interleaved between the cathodes of the subsequent bipolar element.

6. The bipolar electrolyzer of claim 1 wherein the anodes are parallel to, spaced from, and electrically and mechanically connected to the anodic side of the bipolar element, and the cathodes are parallel to, spaced from, and electrically and mechanically connected to the cathodic side of the bipolar element.

7. The bipolar electrolyzer of claim 6 comprising a permionic membrane between an anode and a cathode of an individual electrolytic cell, wherein said anode comprises an electrocatalytic surface bearing upon one side of the permionic membrane, and said cathode comprises an electrocatalytic surface bearing upon the opposite side of the permionic membrane.

8. The bipolar electrolyzer of claim 1 wherein the distance from the second joint to the nearest first joint is at least twice the thickness of the second plate.

* * * * *